United States Patent [19]

Vanier

[11] Patent Number: 4,753,920

[45] Date of Patent: Jun. 28, 1988

[54] POLYMERIC BINDER FOR AMINO-MODIFIED SILICONE SLIPPING LAYER FOR DYE-DONOR ELEMENT USED IN THERMAL DYE TRANSFER

[75] Inventor: Noel R. Vanier, Rochester, N.Y.

[73] Assignee: Eastman Kodak Company, Rochester, N.Y.

[21] Appl. No.: 107,827

[22] Filed: Oct. 13, 1987

[51] Int. Cl.[4] ..... B41M 5/035; B41M 5/26

[52] U.S. Cl. ..... 503/227; 8/471; 427/146; 427/256; 428/195; 428/341; 428/447; 428/480; 428/481; 428/508; 428/510; 428/913; 428/914

[58] Field of Search ..... 8/471; 427/146, 256; 428/195, 341, 447, 480, 481, 508, 510, 913, 914

[56] References Cited

FOREIGN PATENT DOCUMENTS

| | | | |
|---|---|---|---|
| 163145 | 6/1985 | European Pat. Off. | 503/227 |
| 0169705 | 1/1986 | European Pat. Off. | 503/227 |
| 0151096 | 8/1985 | Japan | 503/227 |
| 61-027087 | 8/1985 | Japan | 503/227 |

*Primary Examiner*—Bruce H. Hess

*Attorney, Agent, or Firm*—Harold E. Cole

[57] ABSTRACT

A dye-donor element for thermal dye transfer comprising a support having on one side thereof a dye layer and on the other side a slipping layer comprising a lubricating material dispersed in a polymeric binder, the lubricating material comprising a linear or branched aminoalkyl-terminated poly(dialkyl, diaryl or alkylaryl siloxane) such as an aminopropyldimethyl-terminated polydimethylsiloxane and said polymeric binder comprises cellulose acetate propionate, cellulose nitrate or cellulose acetate hydrogen phthalate. The particular binders used minimize sticking and dye crystallization when the dye-donor element is wound up upon itself.

19 Claims, No Drawings

POLYMERIC BINDER FOR AMINO-MODIFIED SILICONE SLIPPING LAYER FOR DYE-DONOR ELEMENT USED IN THERMAL DYE TRANSFER

This invention relates to dye-donor elements used in thermal dye transfer, and more particularly to the use of particular binders in an amino-modified silicone slipping layer on the back side thereof.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

A problem has existed with the use of dye-donor elements for thermal dye-transfer printing because a thin support is required in order to provide effective heat transfer. For example, when a thin polyester film is employed, it softens when heated during the printing operation and then sticks to the thermal printing head. This causes intermittent rather than continuous transport across the thermal head. The dye transferred thus does not appear as a uniform area, but rather as a series of alternating light and dark bands (chatter marks). Another defect called "smiles", which are crescent shaped low density areas, is produced in the receiving element by stretch-induced folds in the dye-donor. Another defect is produced in the receiving element when abraded or melted debris from the back of the dye-donor builds up on the thermal head and causes steaks parallel to the travel direction and extending over the entire image area. In extreme cases, sufficient friction is often created to tear the dye-donor element during printing. It would be desirable to eliminate such problems in order to have a commercially acceptable system.

European Patent Application No. 163,145 relates to dye-donar elements having a slipping layer on the back side thereof comprising a lubricant in a resin binder along with particulate material. A large list of lubricating materials is disclosed including various modified silicone oils such as an amino-modified silicone oil. No specific examples are disclosed, however. In addition, the slipping layer in that publication has a rough surface due to the presence of particulate material in order to prevent the dye-donor sheet from sticking to the thermal printing head. Such particulate material could have an abrading effect on the printing head, however, and is undesirable for that reason.

JP No. 61/027,087 relates to a heat-sensitive recording sheet containing a heat-sensitive layer on one side thereof consisting of an intramolecular siloxane bond-containing resin. The resin is formed by reacting a siloxane with other materials to form a polyurea resin, a polyurethane resin, a polyamide resin, etc. In all of those resins, however, there are no free amino groups remaining after reaction.

In U.S. application Ser. No. 062,796, of Vanier et al., filed June 16, 1987, amino-modified silicone slipping layers are disclosed and claimed. While these materials have good slipping layer properties, a problem has developed when the dye-donor element is would up on itself. There is a tendency for sticking and dye crystallization in the dye-binder layer to occur when certain binders are used for the slipping layer. It would be desirable to lessen or eliminate those problems.

Accordingly, this invention relates to a dye-donor element for thermal dye transfer comprising a support having on one side thereof a dye layer and on the other side a slipping layer comprising a lubricating material dispersed in a polymeric binder, and wherein the lubricating material comprises a linear or branched aminoalkyl-terminated poly(dialkyl, diaryl or alkylaryl siloxane) and said polymeric binder comprises cellulose acetate propionate, cellulose nitrate or cellulose acetate hydrogen phthalate. Use of these particular binders lessens the sticking and dye crystallization problems described above.

In a preferred embodiment of the invention, the polysiloxane is present in an amount of from about 0.0005 to 0.05 g/m$^2$, representing approximately 0.1 to 10% of the binder weight.

Any polysiloxane can be employed in the slipping layer of the invention providing it is a linear or branched poly(dialkyl, diaryl or alkylaryl siloxane) containing one or more aminoalkyl terminal units. In a preferred embodiment of the invention, the siloxane is an aminopropyldimethyl-terminated polydimethylsiloxane such as one having the formula:

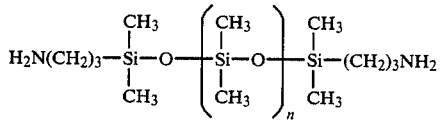

wherein n is from about 10 to about 2000. This material is supplied commercially from Petrarch Systems, Inc. Bartram Rd. Bristol, Pa. 19007 as PS513 ®.

In another embodiment of the invention, the siloxane polymer is a T-structure polydimethylsiloxane with an aminoalkyl functionality at the branchpoint, such as one having the formula

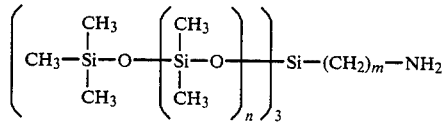

wherein m is from about 1 to about 10 and n is from about 10 to about 1000. This material is supplied commercially from Petrarch Systems, Inc. as PS054 ®.

As noted above, the polymeric binder used in the slipping layer of the invention comprises cellulose acetate propionate, cellulose nitrate or cellulose acetate hydrogen phthalate. In the cellulose acetate propionate, the acetyl content preferably ranges from about 2 to about 3%, the propionyl content preferably ranges from about 35 to about 50%, and the hydroxyl content preferably ranges from about 1.5 to about 7%. In the cellulose nitrate, the nitration preferably ranges from about 60 to about 80%. In the cellulose acetate hydrogen phthalate, the acetyl content preferably ranges from about 18 to about 25% and the phthalyl content preferably ranges from about 25 to about 40%.

In a preferred embodiment of the invention, the binder is cellulose acetate propionate since it is available in a variety of viscosities and does not require chlorinated solvents for coating.

The amount of polymeric binder used in the slipping layer of the invention is not critical. In general the polymeric binder may be present in an amount of from about 0.1 to about 2 g/m$^2$.

Any dye can be used in the dye layer of the dye-donor element of the invention provided it is transferable to the dye-receiving layer by the action of heat. Especially good results have been obtained with sublimable dyes. Examples of sublimable dyes include anthraquinone dyes, e.g., Sumikalon Violet RS ® (product of Sumitomo Chemical Co., Ltd.), Dianix Fast Violet 3R-FS ® (product of Mitsubishi Chemical Industries, Ltd.), and Kayalon Polyol Brilliant Blue N-BGM ® and KST Black 146 ® (products of Nippon Kayaku Co., Ltd.); azo dyes such as Kayalon Polyol Brilliant Blue BM ®, Kayalon Polyol Dark Blue 2BM ®, and KST Black KR ® (products of Nippon Kayaku Co., Ltd.), Sumickaron Diazo Black 5G ® (product of Sumitomo Chemical Co., Ltd.), and Miktazol Black 5GH ® (product of Mitsui Toatsu Chemicals, Inc.); direct dyes such as Direct Dark Green B ® (product of Mitsubishi Chemical Industries, Ltd.) and Direct Brown M ® and Direct Fast Black D ® (products of Nippon Kayaku Co. Ltd.); acid dyes such as Kayanol Milling Cyanine 5R ® (product of Nippon Kayaku Co. Ltd.); basic dyes such as Sumicacryl Blue 6G ® (product of Sumitomo Chemical Co., Ltd.), and Aizen Malachite Green ® (product of Hodogaya Chemical Co., Ltd.);

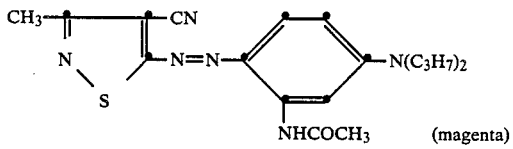

(magenta)

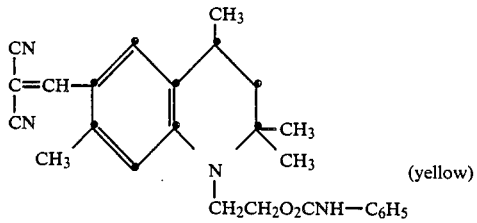

(yellow)

-continued

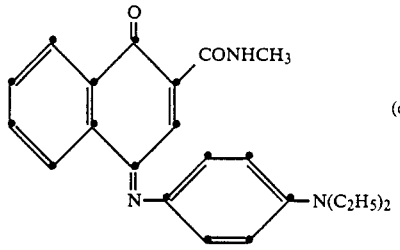

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogen phthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or prined thereon by a printing technique such as a gravure process.

Any material can be used as the support for the dye-donor element of the invention provided it is dimensionally stable and can withstand the heat of the thermal printing heads. Such materials include polyesters such as poly(ethylene terephthalate); polyamides; polycarbonates; glassine paper; condenser paper; cellulose esters such as cellulose acetate; fluorine polymers such as polyvinylidene fluoride or poly(tetrafluoroethylene-co-hexafluoropropylene); polyethers such as polyoxymethylene; polyacetals; polyolefins such as polystyrene, polyethylene, polypropylene or methylpentane polymers; and polyimides such as polyimide-amides and polyether imides. The support generally has a thickness of from about 2 to about 30 μm. It may also be coated with a subbing layer, if desired.

The dye-receiving element that is used with the dye-donor element of the invention usually comprises a support having thereon a dye image-receiving layer. The support may be a transparent film such as a poly(ether sulfone), a polyimide, a cellulose ester such as cellulose acetate, a poly(vinyl alcohol-co-acetal) or a poly(ethylene terephthalate). The support for the dye-receiving element may also be reflective such as baryta-coated paper, polyethylene-coated paper, white polyester (polyester with white pigment incorporated therein), an ivory paper, a condenser paper or a synthetic paper such as duPont Tyvek ®. In a preferred embodiment, polyester with a white pigment incorporated therein is employed.

The dye image-receiving layer may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$.

As noted above, the dye-donor elements of the invention are used to form a dye transfer image. Such a process comprises imagewise-heating a dye-donor element as described above and transferring a dye image to a dye-receiving element to form the dye transfer image.

The dye-donor element of the invention may be used in sheet form or in a continuous roll or ribbon. If a continuous roll or ribbon is employed, it may have only one dye thereon or may have alternating areas of different dyes, such as sublimable cyan, magenta, yellow, black, etc., as described in U.S. Pat. No. 4,541,830. Thus, one-, two- three- or four-color elements (or higher numbers also) are included within the scope of the invention.

In a preferred embodiment of the invention, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements of the invention are available commercially. There can be employed, for example, a Fujitsu Thermal Head (FTP-040 MCSOO1), a TDK Thermal Head F415 HH7-1089 or a Rohm Thermal Head KE 2008-F3.

A thermal dye transfer assemblage of the invention comprises (a) a dye-donor element as described above, and (b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following example is provided to illustrate the invention.

EXAMPLE

A cyan dye-donor element was prepared by coating on a 6 μm poly(ethylene terephthalate) support:

(1) a subbing layer of a titanium alkoxide (duPont Tyzor TBT ®)(0.12 g/m$^2$) from a n-propyl acetate and n-butyl alcohol solvent mixture, and (2) a dye layer containing the cyan dye illustrated above (0.28 g/m$^2$) and duPont DLX-6000 Teflon ® micropowder (0.016 g/m$^2$), in a cellulose acetate propionate (2.5% acetyl, 45% propionyl) binder (0.44 g/m$^2$) coated from a toluene, methanol and cyclopentanone solvent mixture.

On the back side of the dye-donor was coated:

(1) a subbing layer of a titanium alkoxide (duPont Tyzor TBT ®)(0.12 g/m$^2$) from a n-propyl acetate and 1-butanol solvent mixture, and (2) a slipping layer of the siloxane described below (0.016 g/m$^2$) neutralized with 0.0004 g/m$^2$ p-toluene sulfonic acid in the binders, each at 0.54 g/m$^2$, indicated below.

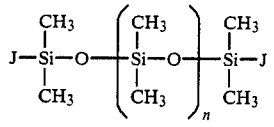

J=—$(CH_2)_3NH_2$

Available commercially from Petrarch Systems, Inc.: PS-513 (viscosity: 2000 ctsk. ~2300 mw)

Control Binders (coated from toluene and 3-pentanone solvent mixture)

(A) Cellulose acetate butyrate (2.8% acetyl, 50% butyryl)

(B) Ethyl cellulose (Hercules Corp. type 50)

(C) Poly(styrene-co-acrylonitrile) (30:70 wt. ratio)

(D) Poly(vinyl alcohol-benzal) (Butvar 76 ® Monsanto Corp.)

(E) Poly(vinyl acetate)

(F) Poly(methyl methacrylate)

Invention Binders (coated from toluene and 3-pentanone solvent mixture)

(1) Cellulose acetate propionate (2.5% acetyl, 45% propionyl, 2.8% hydroxyl)

(2) Cellulose acetate propionate (2.5% acetyl, 40% propionyl, 5.0% hydroxyl)

(3) Cellulose nitrate (an ester of cellulose and nitric acid, 77% nitrated (4) Cellulose acetate hydrogen phthalate (19–24% acetyl, 30–36% phthalyl)

The coated dye-donors were rolled with moderate tension on a 22 mm diameter cylindrical wooden dowel (60 g) and incubated for three days at 60° C., 60% RH. After this period of time, the ease of unwinding of the dye-donor and visual observance of dye crystals that formed within the dye layer were recorded using the following categories:

Sticking

1. Roll unwound freely by holding one end and letting it fall by gravity.
2. Roll unwound but with a slight cracking noise.
3. Roll unwound but with distinct cracking noise.
4. Roll barely unwound.
5. Roll failed to unwind.

Dye Crystallization

1. No crystals visible.
2. Barely noticeable crystal formation.
3. Moderate crystal formation.
4. Substantial crystal formation.
5. Virgual complete crystal formation.

The following results were obtained:

TABLE

| Binder | Sticking | Dye Crystals |
|---|---|---|
| A (Control) | 4 | 5 |
| B (Control) | 4 | 3 |
| C (Control) | 3 | 5 |
| D (Control) | 5 | 5 |
| E (Control) | 5 | 5 |
| F (Control) | 3 | 5 |
| 1 | 1 | 3 |
| 2 | 2 | 2 |
| 3 | 1 | 2 |

TABLE-continued

| Binder | Sticking | Dye Crystals |
|---|---|---|
| 4 | 2 | 1 |

The above results indicate that the polymeric binders of the invention have less front to backside sticking or dye crystals or both than other closely-related polymeric binders.

The invention has been described in detail with particular reference to preferred embodiments thereof, but it will be understood that variations and modifications can be effected within the spirit and scope of the invention.

What is claimed is:

1. In a dye-donor element for thermal dye transfer comprising a support having on one side thereof a dye layer and on the other side a slipping layer comprising a lubricating material dispersed in a polymeric binder, the improvement wherein said lubricating material comprises a linear or branched aminoalkyl-terminated poly(dialkyl, diaryl or alkylaryl siloxane) and said polymeric binder comprises cellulose acetate propionate, cellulose nitrate or cellulose acetate hydrogen phthalate.

2. The element of claim 1 wherein said polysiloxane is present in an amount of from about 0.0005 to about 0.05 $g/m^2$, representing approximately 0.1 to 20% of the binder weight.

3. The element of claim 1 wherein said polymeric binder is cellulose acetate propionate.

4. The element of claim 1 wherein said siloxane is an aminopropyldimethyl-terminated polydimethylsiloxane.

5. The element of claim 4 wherein said polysiloxane has the formula:

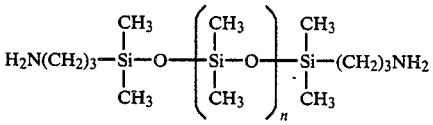

wherein n is from about 10 to about 2000.

6. The element of claim 1 wherein said support comprises poly(ethylene terephthalate).

7. The element of claim 6 wherein said dye layer comprises sequential repeating areas of cyan, magenta and yellow dye.

8. In a process of forming a dye transfer image comprising (a) imagewise-heating a dye-donor element comprising a support having on one side thereof a dye layer and on the other side a slipping layer comprising a lubricating material dispersed in a polymeric binder, and (b) transferring a dye image to a dye-receiving element to form said dye transfer image, the improvement wherein said lubricating material comprises a linear or branched aminoalkyl-terminated poly(dialkyl, diaryl or alkylaryl siloxane) and said polymeric binder comprises cellulose acetate propionate, cellulose nitrate or cellulose acetate hydrogen phthalate.

9. The process of claim 8 wherein said polysiloxane is present in an amount of from about 0.0005 to about 0.05 $g/m^2$, representing approximately 0.1 to 10% of the binder weight.

10. The process of claim 8 wherein said polymeric binder is cellulose acetate propionate.

11. The process of claim 8 wherein said siloxane is an aminopropyldimethyl-terminated polydimethylsiloxane.

12. The process of claim 11 wherein said polysiloxane has the formula:

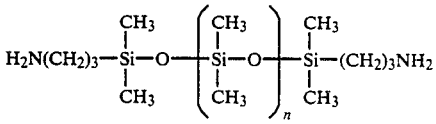

wherein n is from about 10 to about 2000.

13. The process of claim 8 wherein said support is poly(ethylene terephthalate) which is coated with sequential repeating areas of cyan, magenta and yellow dye, and said process steps are sequentially performed for each color to obtain a three-color dye transfer image.

14. In a thermal dye transfer assemblage comprising:

(a) a dye-donor element comprising a support having on one side thereof a dye layer and on the other side a slipping layer comprising a lubricating material dispersed in a polymeric binder, and (b) a dye-receiving element comprising a support having thereon a dye image-receiving layer, said dye-receiving element in a superposed relationship with said dye-donor element so that said dye layer is in contact with said dye image-receiving layer, the improvement wherein said lubricating material comprises a linear or branched aminoalkyl-terminated poly(dialkyl, diaryl or alkylaryl siloxane) and said polymeric binder comprises cellulose acetate propionate, cellulose nitrate or cellulose acetate hydrogen phthalate.

15. The assemblage of claim 14 wherein said polysiloxane is present in an amount of from about 0.0005 to about 0.05 $g/m^2$, representing approximately 0.1 to 10% of the binder weight.

16. The assemblage of claim 14 wherein said polymeric binder is cellulose acetate propionate.

17. The assemblage of claim 14 wherein said siloxane is an aminopropyldimethyl-terminated polydimethylsiloxane.

18. The assemblage of claim 17 wherein said polysiloxane has the formula:

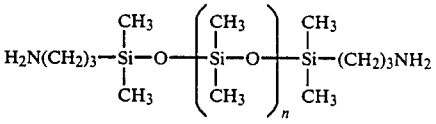

wherein n is from about 10 to about 2000.

19. The assemblage of claim 14 wherein said support of the dye-donor element comprises poly(ethylene terephthalate) and said dye layer comprises sequential repeating areas of cyan, magenta and yellow dye.

* * * * *